US010025270B2

(12) United States Patent
Takahashi et al.

(10) Patent No.: US 10,025,270 B2
(45) Date of Patent: Jul. 17, 2018

(54) IMAGE FORMING APPARATUS

(71) Applicant: CANON KABUSHIKI KAISHA, Tokyo (JP)

(72) Inventors: Hiroyuki Takahashi, Abiko (JP); Takuya Matsumura, Kashiwa (JP); Chiharu Kageyama, Ryugasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/623,901

(22) Filed: Jun. 15, 2017

(65) Prior Publication Data

US 2017/0364027 A1 Dec. 21, 2017

(30) Foreign Application Priority Data

Jun. 21, 2016 (JP) ..... 2016-122299

(51) Int. Cl.
*G03G 21/20* (2006.01)

(52) U.S. Cl.
CPC ... *G03G 21/206* (2013.01); *G03G 2221/1645* (2013.01)

(58) Field of Classification Search
CPC ..... G03G 21/206; G03G 2221/1645
See application file for complete search history.

(56) References Cited

U.S. PATENT DOCUMENTS 9,791,830 B2 * 10/2017 Fujiya ..... G03G 21/206
2008/0050145 A1 * 2/2008 Hanano ..... G03G 15/2017 399/93
2011/0085819 A1 * 4/2011 Akagawa ..... A61L 9/014 399/93
2011/0121510 A1 * 5/2011 Tsuda ..... G03G 15/0258 271/226
2011/0262175 A1 * 10/2011 Takahashi ..... G03G 21/206 399/92

(Continued)

FOREIGN PATENT DOCUMENTS

JP H10-198238 A 7/1998
JP 2004-271933 A 9/2004

(Continued)

OTHER PUBLICATIONS

U.S. Appl. No. 15/585,522, filed May 3, 2017 (First named inventor: Takuya Matsumura).

*Primary Examiner* — Ryan Walsh
(74) *Attorney, Agent, or Firm* — Fitzpatrick, Cella, Harper & Scinto

(57) ABSTRACT

An exhaust duct provided on a back surface side of an image forming apparatus, and including a plurality of air ducts through which air inside the apparatus is exhausted toward outside the apparatus, a plurality of filters provided in the plurality of air ducts, respectively, and which removes a fine particle included in the air exhausted through the air ducts, and a filter case that houses the plurality of filters in a manner that the filters are able to be taken out from the filter case are included, and the filter case is provided in a drawable manner to one of side surface sides in a right and left direction or to an upper surface side in an up and down direction of the image forming apparatus, from a front surface side to a back surface side of the image forming apparatus, with respect to the image forming apparatus.

9 Claims, 12 Drawing Sheets

(56) References Cited

U.S. PATENT DOCUMENTS

| | | | | |
|---|---|---|---|---|
| 2012/0240534 | A1* | 9/2012 | Ryuzaki | G03G 21/206 55/385.4 |
| 2015/0071677 | A1* | 3/2015 | Hirasawa | G03G 21/206 399/94 |
| 2015/0117894 | A1* | 4/2015 | Nakayama | F24F 13/28 399/92 |
| 2017/0336757 | A1* | 11/2017 | Matsumura | G03G 21/206 |

FOREIGN PATENT DOCUMENTS

| | | | |
|---|---|---|---|
| JP | 2010-096984 | A | 4/2010 |
| JP | 2015-158580 | A | 9/2015 |

* cited by examiner

IMAGE FORMING APPARATUS

BACKGROUND OF THE INVENTION

Field of the Invention

The present invention relates to an image forming apparatus such as a copying machine, a printer, or a facsimile device.

Description of the Related Art

Conventionally, in Japanese Patent Laid-Open No. 2004-271933, an exhaust port for exhausting heat inside an apparatus is arranged on a back surface side (depth side) of an apparatus main body. Here, the back surface side of the apparatus main body is an opposite side of a front surface side (front side), where a side operated by an operator is the front surface side (front side) of the image forming apparatus. Further, a plurality of filters for removing a fine particle and exhausting the air is arranged in a vicinity of the exhaust port. The fine particle is, for example, ozone and a floating toner which are included in the air to be exhausted and generated in the apparatus at the time of forming an image.

However, the configuration of Japanese Patent Laid-Open No. 2004-271933 requires an access from the back surface side (depth side) of the image forming apparatus in replacement of the filter. Therefore, securement of a work space on the back surface side of the image forming apparatus in periodic maintenance places a burden on the operator.

Further, a plurality of filters having different functions such as ozone absorption and dust collection is required for the conventional filters. Further, there is a possibility of leakage of an ultrafine particle (UFP) such as ozone or a toner if sealing between air flows that respectively pass through the plurality of filters is not secured.

SUMMARY OF THE INVENTION

The present invention is an image forming apparatus including:

an exhaust duct provided on a back surface side of the image forming apparatus, including a first air duct and a second air duct through which air inside the apparatus is exhausted toward outside the apparatus in an exhaust direction, the first air duct and the second air duct being partitioned by a partition member;

a filter case provided in a drawable manner in a drawing direction perpendicular to the exhaust direction to one of side surface sides in a right and left direction or to an upper surface side in an up and down direction of the image forming apparatus, when viewing the image forming apparatus from a front surface side to the back surface side of the image forming apparatus; and a first filter and a second filter provided in the first air duct and the second air duct, respectively, configured to remove a fine particle included in the air, the first filter being provided in a more downstream side than the second filter in the drawing direction, the first filter and the second filter being housed in a manner that the filters are able to be taken out from the filter case, the first filter partially superimposing the partition member and the second filter not superimposing the partition member when viewing the image forming apparatus from the drawing direction.

Further features of the present invention will become apparent from the following description of exemplary embodiments with reference to the attached drawings.

DESCRIPTION OF THE EMBODIMENTS

Hereinafter, favorable embodiments of the present invention will be exemplarily described in detail with reference to the drawings. Note that dimensions, materials, shapes, and relative arrangements of configuration parts described in the embodiments below should be appropriately changed according to a configuration of an apparatus to which the present invention is applied and various conditions. Therefore, it is not intended to limit the scope of the present invention to the embodiments unless otherwise specifically stated.

First Embodiment

Figure 1:
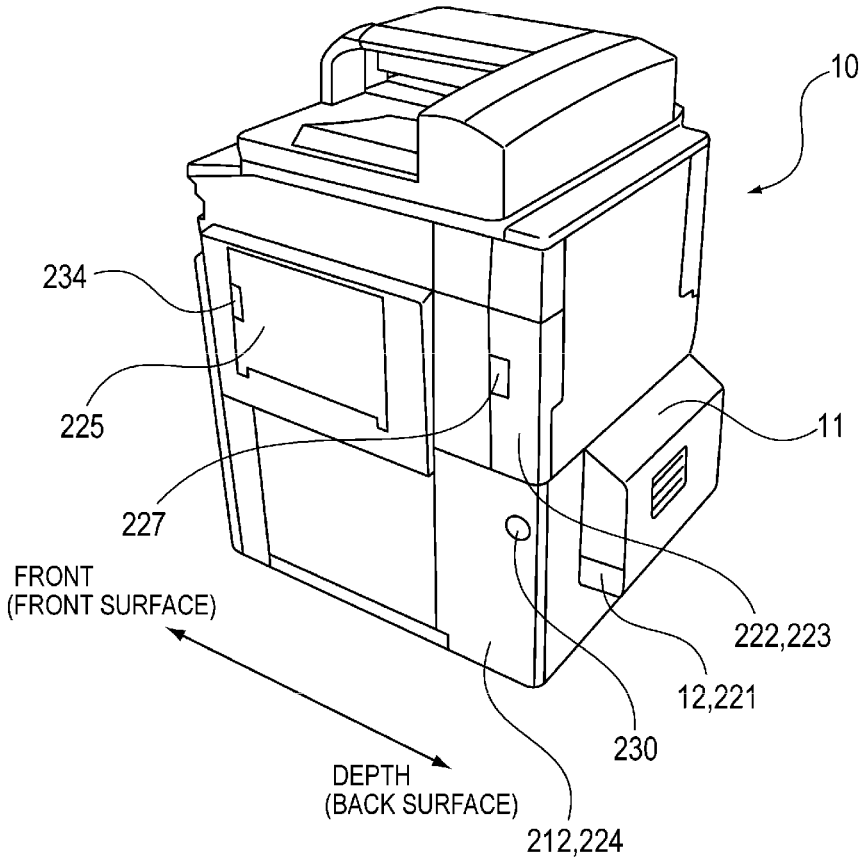
FIG. 1 is an external view of an image forming apparatus.
Figure 2:
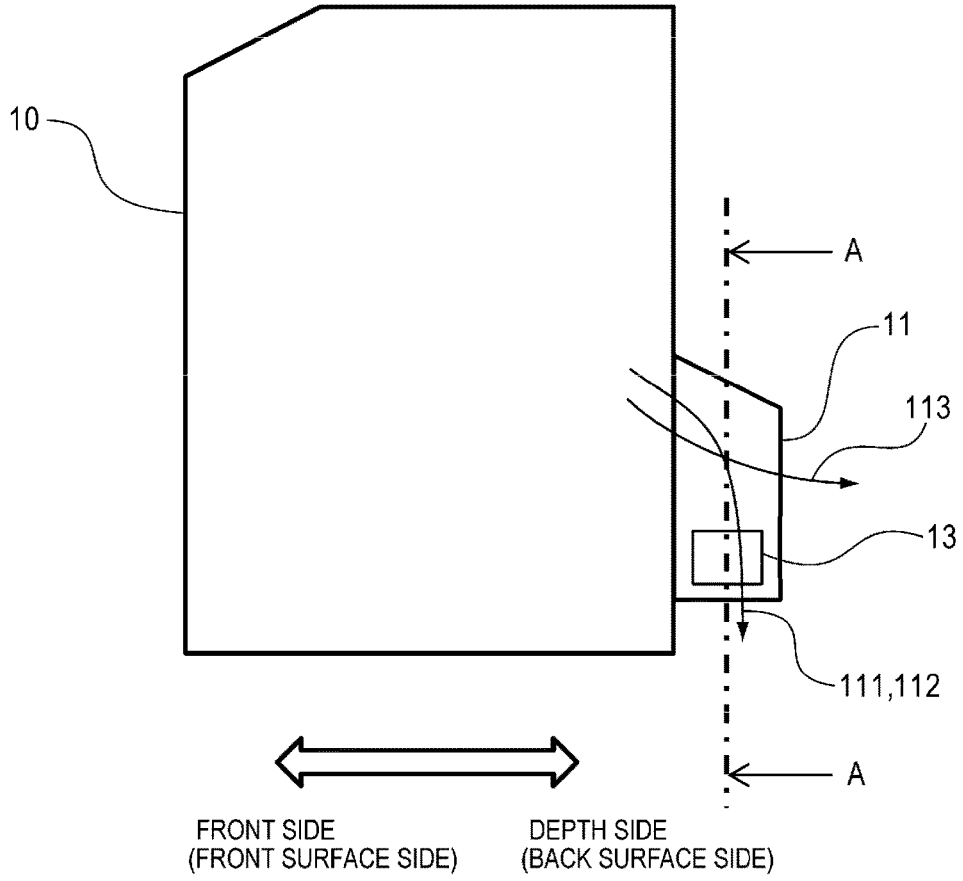
FIG. 2 is a sectional view of an exhaust duct portion of the image forming apparatus.

An image forming apparatus according to a first embodiment of the present invention will be described using FIGS. 1 to 4. FIG. 1 is an external perspective view of an image forming apparatus according to an embodiment of the present invention. FIG. 2 is a schematic sectional view of an image forming apparatus 10 of the present invention as viewed from a side direction of the image forming apparatus 10.

In the image forming apparatus 10, as is known, a toner image is formed on an image bearing member and is transferred to and fixed to a recording material although an inside of the apparatus is not illustrated. That is, a surface of a photosensitive drum (image bearing member) uniformly changed with a charger is irradiated with laser light according to image information, and an electrostatic latent image is formed. Then, the electrostatic latent image is developed with a toner (developer) supplied from a development device, and an image with the toner is formed on the surface of the photosensitive drum. Then, the image with the toner formed on the photosensitive drum is transferred to the recording material, which is supplied sheet by sheet, and the transferred image is fixed to the recording material by a fixing device.

As illustrated in FIGS. 1 and 2, an exhaust duct 11 is provided on aback surface side of the image forming apparatus 10, the exhaust duct 11 being provided with a plurality of air ducts through which the air inside the apparatus is exhausted toward outside the apparatus. Here, the back surface side of the image forming apparatus is an opposite side (depth side) of a front surface side (front side), where a side operated by an operator is the front surface side (front side) of the image forming apparatus. Further, in the description below, an upper surface of the image forming apparatus is an upper-side surface of the image forming apparatus in a height direction (up and down direction) perpendicular to the arrow direction that indicates the front and depth of the image forming apparatus. A lower surface (bottom surface) of the image forming apparatus is a lower-side surface of the image forming apparatus in the height direction, and is a surface on the opposite side of the upper surface. Further, a side surface of the image forming apparatus is a surface of the image forming apparatus in a width direction (right and left direction) perpendicular to the arrow direction that indicates the front and depth of the image forming apparatus and to the up and down direction.

In the above-described image forming apparatus, ozone from the charger, VOC from the fixing device, and an ultrafine particle (UFP) from the toner and the like occur at the time of forming the image. Here, the VOC is a volatile organic compound, and includes formaldehyde, xylene, and the like. When the air inside the apparatus is exhausted from the exhaust duct 11 toward outside the apparatus, the above-described ozone/VOC/UFP and the like need to be prevented from being discharged to the outside of the apparatus. Therefore, the image forming apparatus 10 is provided with a plurality of filters 13 that removes the ozone/VOC/UFP and the like before the air inside the apparatus is exhausted. The plurality of filters 13 is provided in a plurality of air duct, respectively, in the exhaust duct, and removes the fine particle included in the air to be exhausted through the air duct.

In the present embodiment, air ducts below are exemplified as the plurality of air ducts included in the exhaust duct 11. That is, the exhaust duct 11 includes a first air duct 111 through which the air mainly containing the ozone and UFP is exhausted, a second air duct 112 through which the air mainly including the VOC is exhausted, and a third air duct 113 through which heat around the substrate is discharged, the heat not including the fine particle and the like. Among the plurality of air ducts, the first air duct 111 and the second air duct 112 are formed to cause the air to proceed to a bottom surface side of the apparatus, and the third air duct 113 is formed to cause the air to proceed to the back surface side of the apparatus, respectively. Note that the number and the functions of the air ducts included in the exhaust duct are not limited to the above-described configuration, and may just be appropriately set, as needed.

Further, an intake (suction port) of outside air for cooling the inside of the apparatus is arranged in a side surface, a front surface, a bottom surface, or the like of the image forming apparatus 10 (not illustrated).

The plurality of air ducts included in the exhaust duct and the plurality of filters provided in the air ducts will be described in detail using FIGS. 3A and 3B, and 4.

Figure 3A:
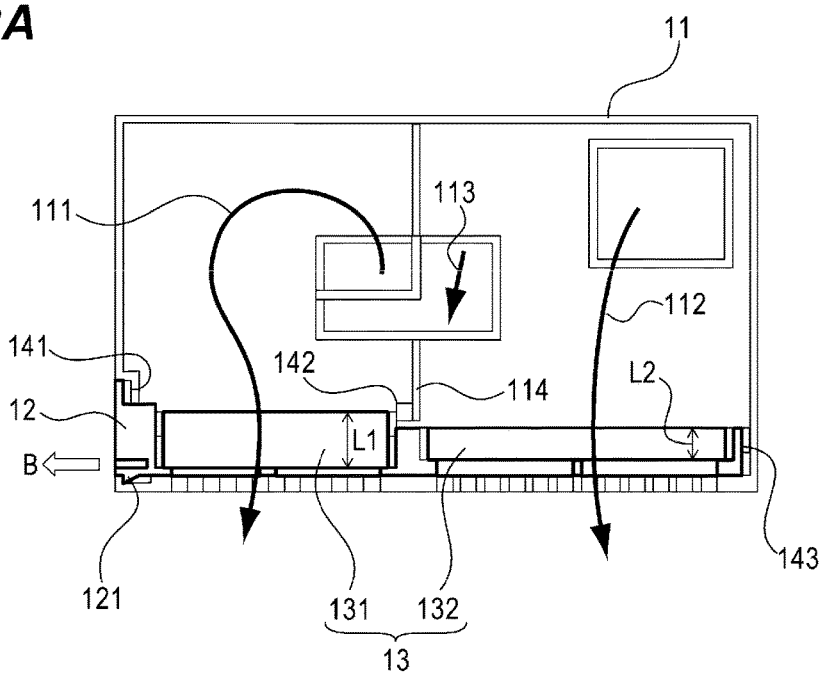
FIGS. 3A and 3B are sectional views of the exhaust duct portion of the first embodiment.
Figure 3B:
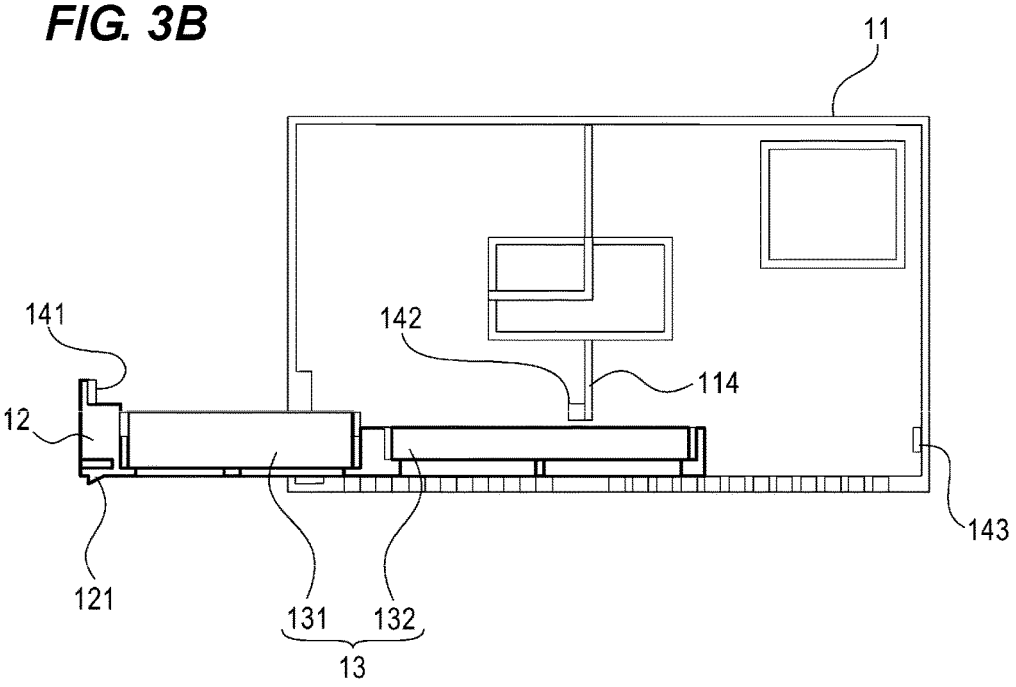
Figure 4:
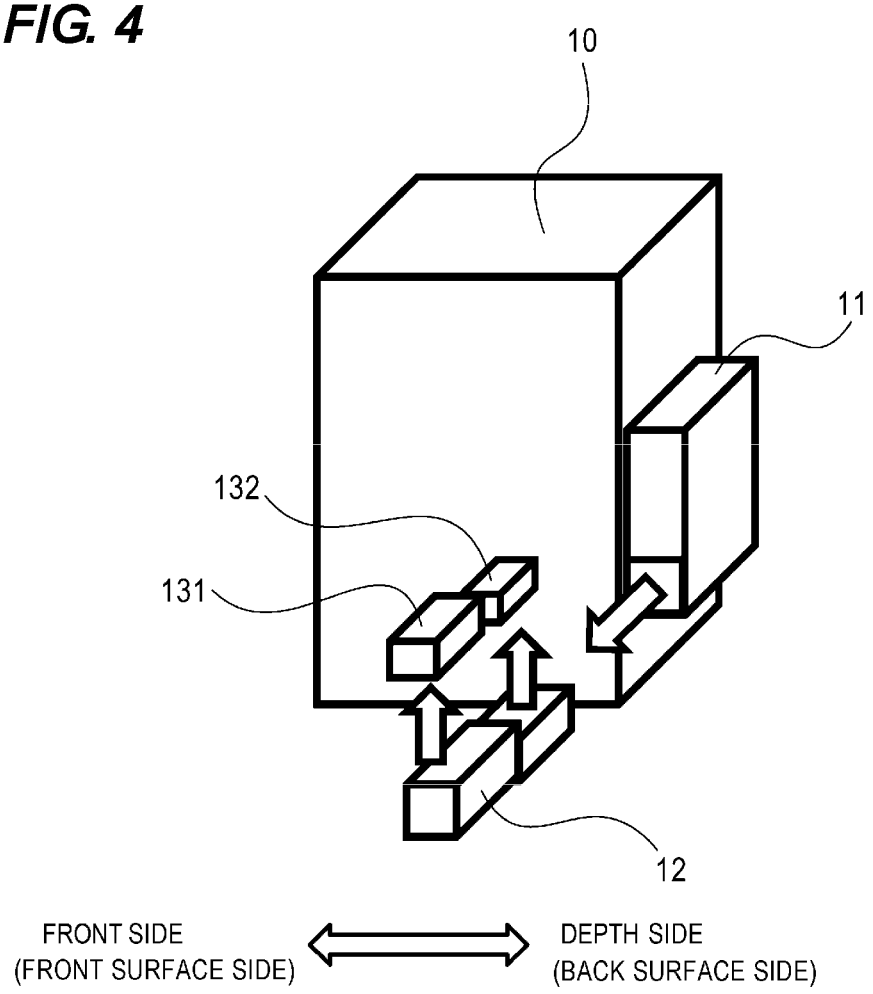
FIG. 4 is a diagram of when a filter case and filters of the first embodiment are taken out.

FIGS. 3A and 3B are A-A sectional views of FIG. 2. FIG. 3A is a sectional view of a state in which the plurality of filters 13 is arranged in the image forming apparatus 10, and illustrates a flow of the air in the duct 11. FIG. 3B is a sectional view of when the plurality of filters 13 is taken out of the image forming apparatus 10. FIG. 4 is a schematic perspective view of when the plurality of filters 13 is taken out of the image forming apparatus 10.

A first filter 131 that filters the UFP and ozone is arranged in the first air duct 111. A second filter 132 that filters the VOC is arranged in the second air duct 112. In the duct 11, partition member 114 (113) that partitions the air between the first air duct 111 and the second air duct 112 is arranged. Further, as illustrated in FIG. 4, the duct 11 is provided with a filter case 12 that houses the first filter 131 and the second filter 132 in a manner that the filters can be taken out. The filter case 12 is provided in a drawable manner to one of side surface sides (into the arrow B direction) in the right and left direction of the image forming apparatus, from the front surface side to the back surface side of the image forming apparatus, with respect to the image forming apparatus 10.

To efficiently exhaust the heat inside the apparatus, lower exhaust resistance is better. To improve removal capability of the ozone/VOC/UFP, emission control of which is tightened in recent years, and to enhance heat emission effect, the filters 13 need to be increased in size and sealing of an exhaust path needs to be strengthened. Further, to prevent occurrence of an image detect and an error due to an abnormal increase in temperature inside the apparatus due to clogging of the filter in long-term use, periodic cleaning or replacement of the filter 13 is necessary. In the present embodiment, the filter case 12 that houses the plurality of filters 13 is made drawable toward the one of side surface sides of the image forming apparatus 10. Therefore, cleaning and replacement work of the plurality of filters 13 can be easily performed without securing a work space on the back surface side of the image forming apparatus 10. Therefore, such a configuration leads to reduction of the work space on the back surface side of the apparatus, and a burden on the operator in periodic maintenance can be reduced. Further, the plurality of filters can be replaced at the same time.

Further, in the present embodiment, the filter 131 housed in the filter case 12 on the front side in the drawing direction, of the plurality of filters 13, is larger in size in the up and down direction perpendicular to the drawing direction B than the filter 132 housed on the depth side (L1>L2 in FIG. 3). When viewed from the drawing direction, the filter 131 is arranged so as to overlap the partition member 114 partly, and the filter 132 is arranged so as not to overlap on the partition member 114. Therefore, as illustrated in FIG. 3A, sealing between the plurality of filters 13 and the partition member 114 can be easily realized at the time of attaching the filter case 12 to the image forming apparatus 10. In doing so, sealing between the air ducts can be secured even in the configuration in which the filter case 12 including the plurality of filters can be taken out in the direction perpendicular to the air ducts.

Next, sealing members 141, 142, and 143 will be described using FIGS. 3A and 3B. The filter case 12 is provided with the sealing member 141 that performs sealing between the filter case 12 and the duct 11. The partition member 114 in the duct 11 is provided with the sealing member 142 that performs sealing between the first air duct 111 and the second air duct 112. The duct 11 is provided with the sealing member 143 that performs sealing between the duct 11 and the filter case 12. In a state where the filter case 12 is attached to the duct 11, the filter case 12 receives a force from the sealing members 141, 142, and 143 in the drawing direction B of the filter case 12. To prevent the filter case 12 from being jumping out in the drawing direction B with the force, the filter case 12 is provided with a stopper 121 to be engaged with the duct 11. The stopper 121 is made of an elastic member and is bent upward in FIG. 3A in taking out the filter case 12, thereby to be disengaged from the duct 11 by an elastic force. With this configuration, the filter case 12 can be taken out of the duct 11 only by cancellation of the engagement of the stopper 121 without using a tool. Further, the filter case becomes replaceable only by the cancellation of the stopper at the time of replacement of the filter while sealability inside the apparatus is secured in ordinary use. An image forming apparatus with high maintainability can be provided.

Second Embodiment

Figure 5:
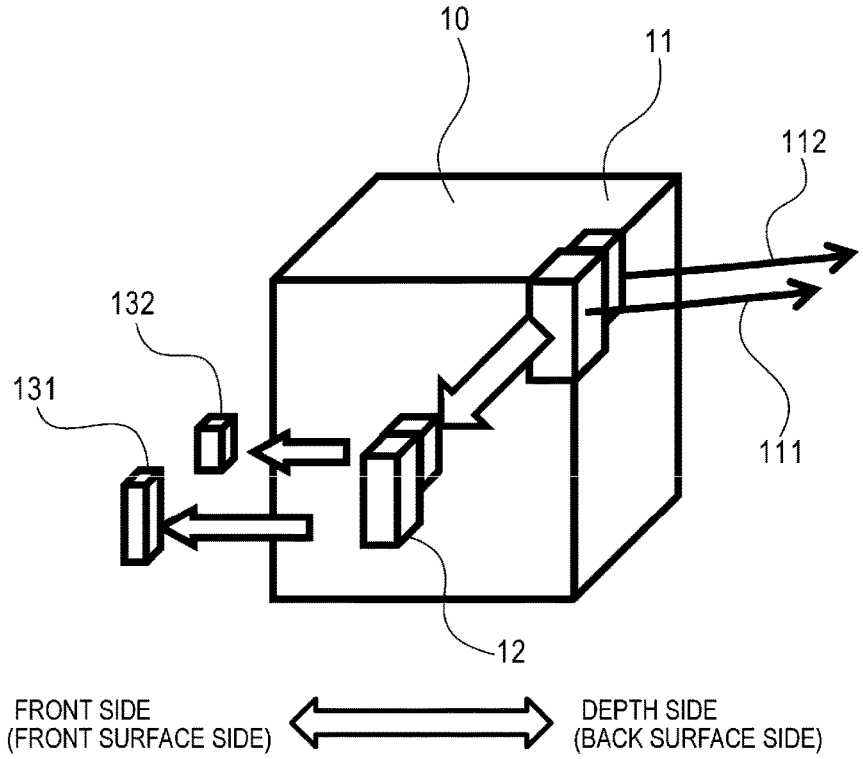
FIG. 5 is a diagram of when a filter case and filters of a second embodiment are taken out.

An image forming apparatus according to a second embodiment of the present invention will be described using FIG. 5. FIG. 5 is a schematic perspective view of an image forming apparatus 10 illustrating the second embodiment of the present invention.

In the first embodiment, the configuration in which the exhaust duct 11 is provided to protrude to an outside of the image forming apparatus 10 on the back surface side has been exemplarily described. According to this configuration, the air exhausted through the first air duct and the second air duct of the exhaust duct can be directed to the lower surface side of the image forming apparatus. In contrast, in the present embodiment, as illustrated in FIG. 5, an exhaust duct 11 is provided inside the image forming apparatus 10. Here, an exhaust port of the image forming apparatus 10 is provided in a back surface of the image forming apparatus 10.

Then, a filter case 12 including a plurality of filters 13 is provided in a drawable manner to one of side surface sides of the image forming apparatus 10, similarly to the above-described first embodiment. As for the sizes of two filters 131 and 132 arranged in the filter case 12, a filter with a larger air duct in size in a sectional area direction (in a direction perpendicular to the drawing direction), of a plurality of air ducts included in the duct 11, is arranged on a front side in the drawing direction of the filter case 12.

In this way, even if the thicknesses of the filters 13 in an air duct direction are the same, the filter with the air duct having the larger sectional area is arranged on the front side in the drawing direction of the filter case 12, whereby downsizing of the filter case 12 is possible and sealing between the air ducts is easy. As a result, space saving of a work space at the time of maintenance of the filter 13 and an installation space of the image forming apparatus 10 can be realized.

Third Embodiment

Figure 6:
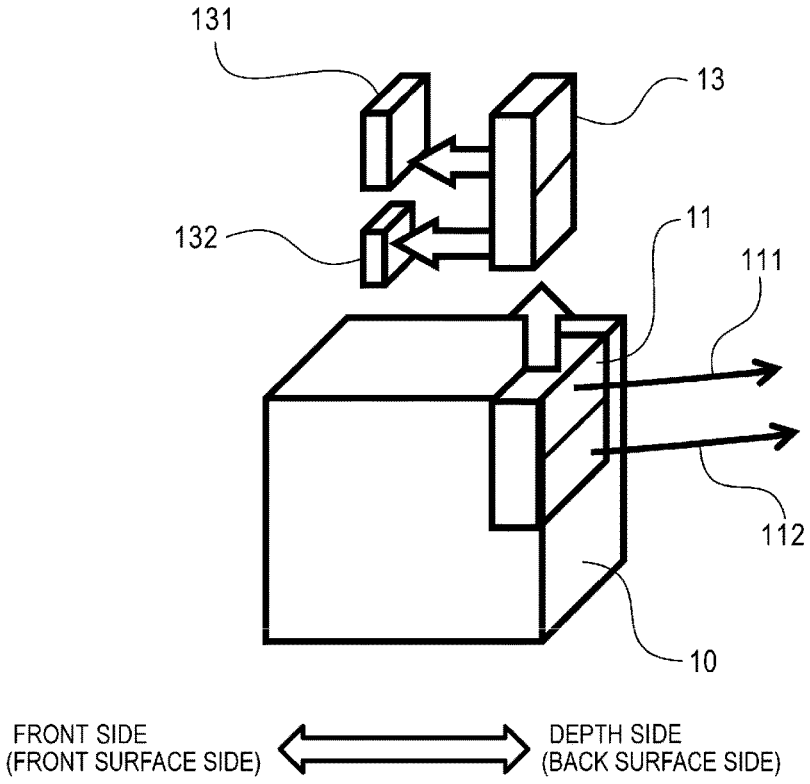
FIG. 6 is a diagram of when a filter case and filters of a third embodiment are taken out.

An image forming apparatus 10 according to a third embodiment of the present invention will be described using FIG. 6. FIG. 6 is a schematic perspective view of the image forming apparatus 10 illustrating the third embodiment of the present invention.

In the first embodiment, the configuration in which the exhaust duct 11 is provided to protrude to an outside of the image forming apparatus 10 on the back surface side has been exemplarily described. According to this configuration, the air exhausted through the first air duct and the second air duct of the exhaust duct can be directed to the lower surface side of the image forming apparatus. In contrast, in the present embodiment, as illustrated in FIG. 6, an exhaust duct 11 is provided inside the image forming apparatus 10. Here, an exhaust port of the image forming apparatus 10 is provided in a back surface of the image forming apparatus 10.

Further, in the first embodiment, the filter case 12 including the plurality of filters 13 is provided in a drawable manner to the one of side surface sides with respect to the image forming apparatus 10. In contrast, in the present embodiment, as illustrated in FIG. 6, a filter case 12 including a plurality of filters 13 is provided in a drawable manner to an upper surface side in an up and down direction (height direction) of the image forming apparatus, with respect to the image forming apparatus 10.

With this configuration, cleaning and replacement work of the plurality of filters 13 can be performed without increasing a work space of the image forming apparatus 10 in taking out the filter case 12 from the image forming apparatus, similarly to the first and second embodiments.

Fourth Embodiment

Figure 7:
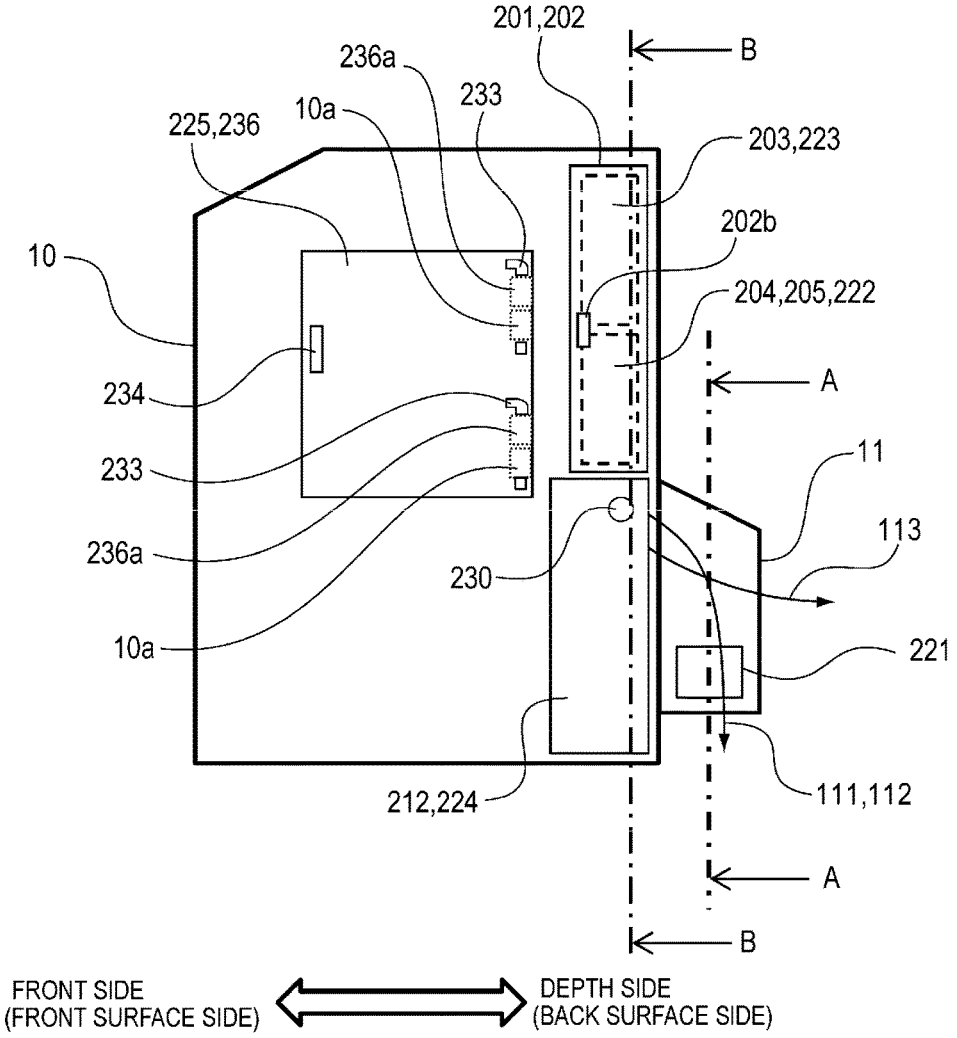
FIG. 7 is a diagram of an access surface of an image forming apparatus of a fourth embodiment.

An image forming apparatus 10 according to a fourth embodiment of the present invention will be described using FIGS. 7 to 12. FIG. 7 is a side view of the image forming apparatus 10 illustrating the fourth embodiment of the present invention.

In the above-described first embodiment, the configuration in which the filter case 12 is provided in a drawable manner to the one of side surface sides of the image forming apparatus 10, with respect to the image forming apparatus 10, has been exemplarily described. That is, the configuration in which an access surface 221 at the time of taking out the filter case 12 is provided to one of side surfaces of the image forming apparatus has been exemplarily described.

In the present embodiment, a maintenance part detachably attachable to the image forming apparatus is provided to the image forming apparatus in a detachably attachable manner from one of side surface sides of the image forming apparatus to which a filter case is drawable, other than filters. That is, the present embodiment has a configuration in which an access surface of another maintenance part other than filters is aggregated and arranged on one of side surfaces of the image forming apparatus, where an access surface 221 at the time of taking out a filter case 12 is provided.

Here, a mass storage device, an electric board, and a collected toner bottle are exemplified as the maintenance parts detachably attachable to the image forming apparatus, other than filters. In the present embodiment, an access surface 222 to the mass storage device, an access surface 223 to the electric board, and an access surface 224 at the time of replacement of the collected toner bottle are aggregated and arranged on one of side surfaces of the image forming apparatus, where the access surface 221 at the time of taking out the filter case 12 is provided. Further, an access surface 225 at the time of attaching a detachably attachable holding member 236, which supplies a recording material as an object to be recorded to an apparatus main body of the image forming apparatus, is arranged on the one of side surfaces of the image forming apparatus, where the access surface 221 at the time of taking out the filter case 12 is provided. The access surfaces to the maintenance parts are aggregated and arranged on the one of side surfaces of the image forming apparatus in this way, whereby the positions of the access surfaces to the maintenance parts are easily recognized by an operator.

Further, the access surface 221 at the time of taking out the filter case 12 is arranged on a depth side (back surface side) of the apparatus with respect to other maintenance parts, on the one of side surfaces. Further, the access surface 222 to the mass storage device, the access surface 223 to the electric board, and the access surface 224 at the time of replacement of the collected toner bottle are arranged on a front side of the apparatus with respect to the access surface 221 to the filter case, on the one of side surfaces. Further, the access surface 224 at the time of replacement of the toner bottle is arranged on a lower side of the apparatus with respect to the access surface 222 to the mass storage device and the access surface 223 to the electric board. Further, the access surface 225 of the holding member 236 is arranged on the front side of the apparatus with respect to the access surfaces 221 to 224, on the one of side surfaces.

The access surface 221 at the time of taking out the filter case is arranged on the depth side of the apparatus in this way, whereby the exhaust port of the air can be arranged in a position away from a user. Further, the access surface 224 at the time of replacement of the collected toner bottle is arranged on a lower side with respect to the access surface 222 to the mass storage device and the access surface 223 to the electric board, whereby a maintenance part heavier than other maintenance parts can be arranged on a lower side, and a burden on the user can be reduced. Further, the access surface 225 of the holding member 236 is arranged on the front side of the image forming apparatus, whereby a recording material supply work surface with a high access frequency can be arranged in a position close to an operator, and the burden on the operator can be reduced.

Figure 8:
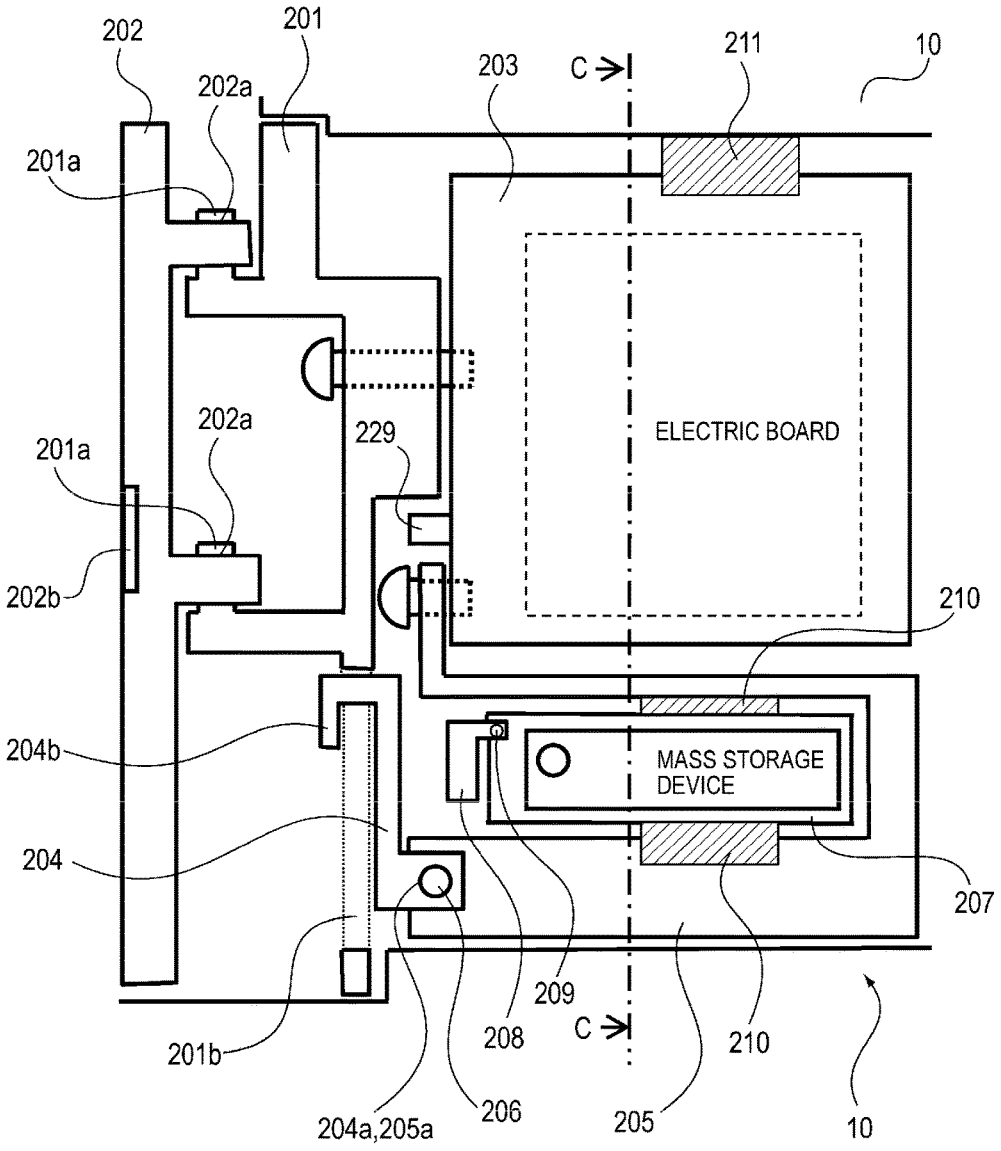
FIG. 8 is a configuration diagram of a periphery of a mass storage device and an electric board.

Detailed configurations of accesses to the mass storage device and the electric board will be described using FIG. 8. FIG. 8 is a B-B sectional view of FIG. 7.

Covers 201 and 202 made of a resin and the like, and which cover the mass storage device and the electric board, are arranged on the one of side surfaces of the image forming apparatus, where the access surfaces of the maintenance parts are aggregated.

A cover includes the two covers 201 and 202. The inner cover 201 is fixed to a substrate housing member 203, which serves a function to house and cover the electric board, by screw fastening at one or more points. The inner cover 201 includes one or more shaft portions 201*a* installed in a protruding manner in an up direction. The outer cover 202 includes a hole 202*a* to be fit with the shaft portion 201*a* included in the inner cover 201. When the hole 202*a* of the outer cover 202 is fit onto the shaft portion 201*a* of the inner cover 201, the inner cover 201 and the outer cover 202 are connected, and the outer cover 202 can be rotated around the shaft portion 201*a* of the inner cover 201, and can be opened and closed. Further, the outer cover 202 includes a grip portion 202*b* arranged on the front side of the image forming apparatus with respect to the shaft portion 201*a*.

A cover member made of a metal and the like is arranged inside the cover including the inner cover 201 and the outer cover 202. The cover member made of a metal and the like includes two cover members. One cover member is a substrate housing member 203 that serves a function to house and cover the electric board and is arranged on an upper side. The other cover member is a cover member 204 that serves a function to cover the mass storage device portion and is arranged on a lower side. The inner cover 201 includes an opening portion 201*b* through which an access becomes possible from the access aggregation surface side (the one of side surface sides of the image forming apparatus) to the cover member 204, when the outer cover 202 is opened around the shaft portion 201*a*.

The mass storage device covered with the cover member 204 on the access aggregation surface side is housed in a case member 205 having a case shape. The case member 205 includes one or more holes 205*a* penetrating in the front and depth direction of the image forming apparatus. The hole 205*a* included in the case member 205 is provided in the case member 205 on a lower side and on the one of side surface sides of the image forming apparatus, where the access surfaces to the maintenance parts are aggregated. The cover member 204 includes a female screw portion 204*a* arranged on the same axis as the hole 205*a* provided in the case member 205 having a case shape in which the mass storage device is housed. The shaft member 206 includes a shaft portion to be fit into the hole 205*a* provided in the case member 205, and a male screw portion to be screwed with the female screw portion 204*a* provided in the cover member 204. The cover member 204 and the case member 205 are connected with the shaft member 206. The cover member 204 can be opened and closed around the shaft of the shaft member 206, and a grip portion 204*b* gripped by the operator to open and close the cover member 204 is arranged on an upper side with respect to the female screw portion. A housing member 207 connected with the mass storage device by screw fastening at one or more points is arranged inside the cover member 204 that can be opened and closed and serves the function to cover the mass storage device. The housing member 207 includes holes in one or more places, which penetrate in the front and depth direction of the image forming apparatus, in positions on the one of side surface sides of the image forming apparatus, where the access surfaces are aggregated and on an upper side of the housing member 207. A handle member 208 includes a hole on the same straight line with the hole provided in the housing member 207. The housing member 207 and the handle member 208 are connected with one or more common fitting shaft members 209, and the handle member 208 is rotatable around the fitting shaft member 209 and serves a function of a handle.

Figure 9:
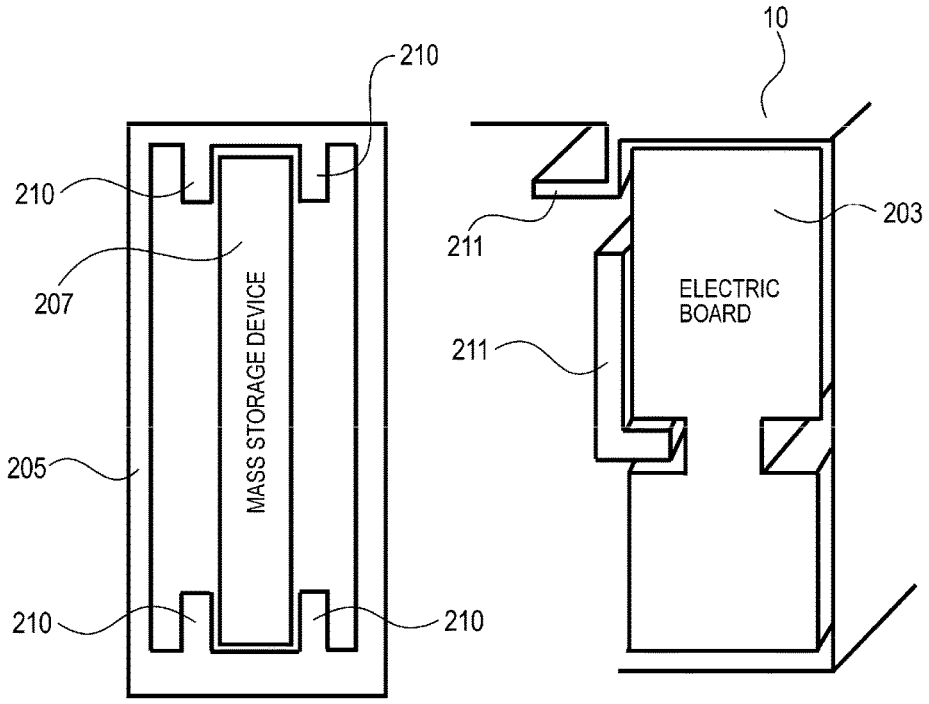
FIG. 9 is an explanatory diagram of an auxiliary mechanism portion of the mass storage device and the electric board.
Figure 10:
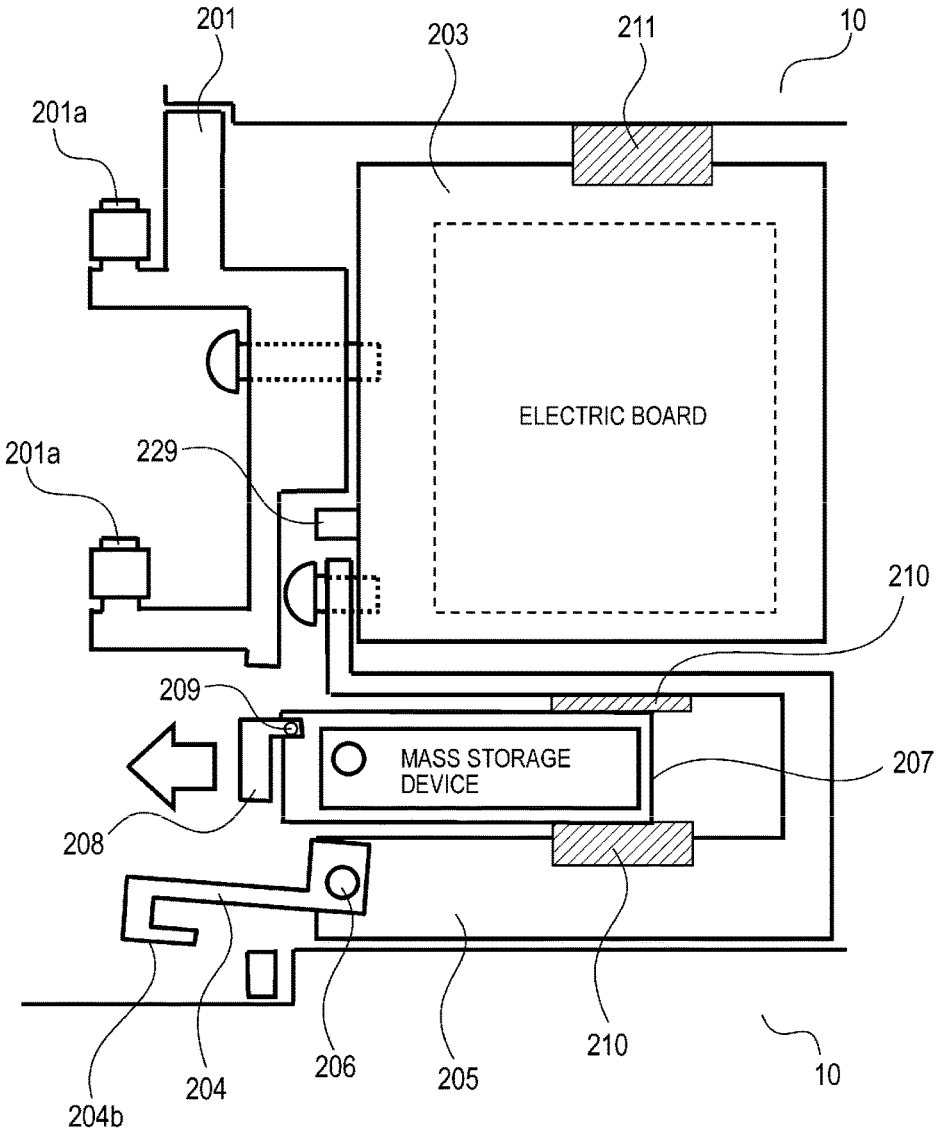
FIG. 10 is a diagram of when the mass storage device is taken out.

Further, a guide member 210 parallel to a taking-out and putting-in direction, for guiding the mass storage device into the taking-out and putting-in direction, is included in one or more surfaces (here, upper and lower two surfaces) inside the case member 205 so that the mass storage device can be taken out and put in from the one of side surface sides of the image forming apparatus. The guide member 210 is illustrated in FIG. 9 that is a C-C sectional view of FIG. 8. With such a guide member 210, the operator can take out and put in the mass storage device of the image forming apparatus from the one of side surface sides, as illustrated in FIG. 10, by opening the outer cover 202, opening the cover member 204, and pulling out the handle member 208.

Figure 11:
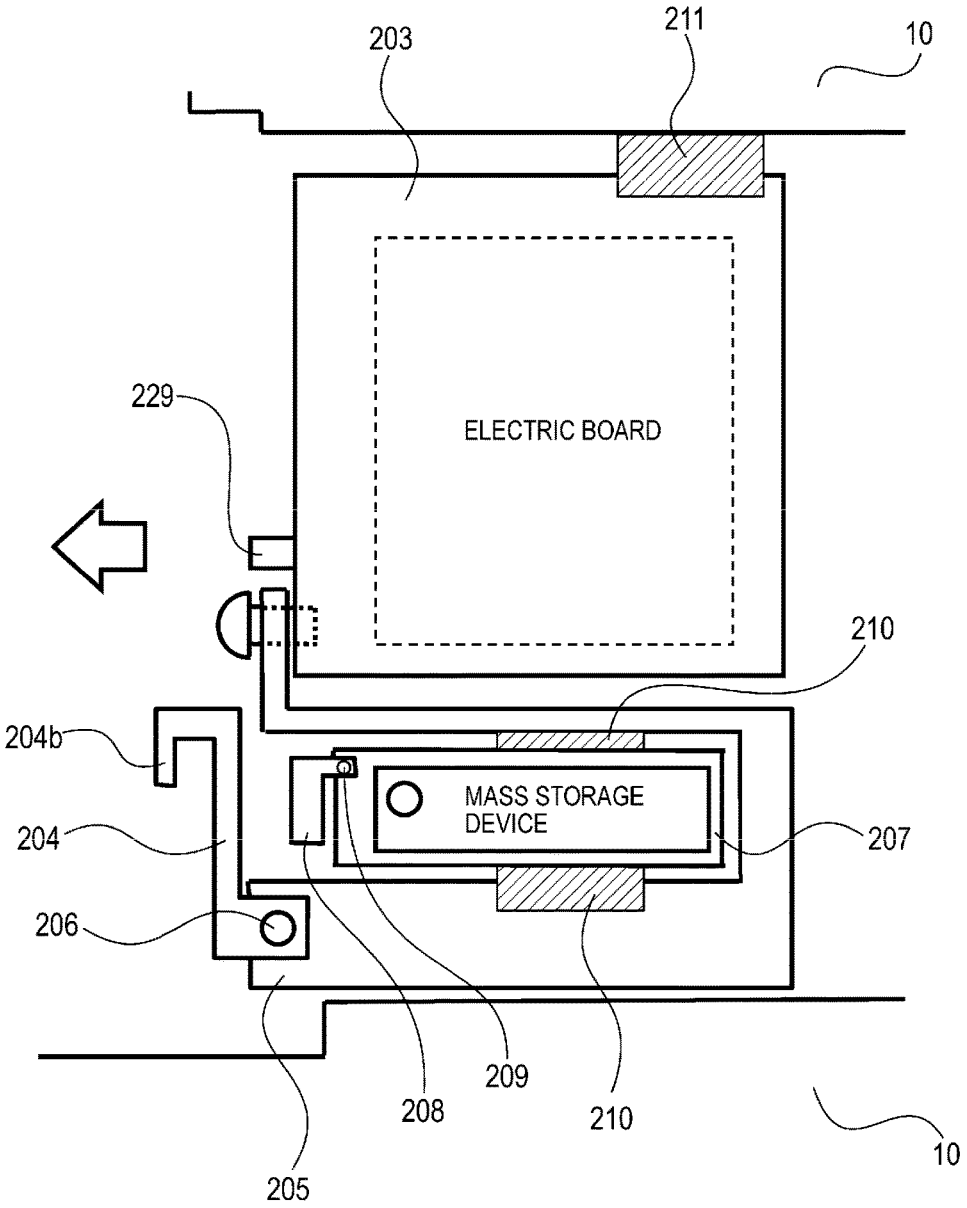
FIG. 11 is a diagram of when the electric board is taken out.

The substrate housing member 203 that serves the function to house and cover the electric board is arranged on an upper side of the cover member 204 that serves the function to cover the mass storage device. The substrate housing member 203 is connected with the case member 205 having a case shape in which the mass storage device is housed, by screw fastening at one or more points, and a handle 229 is arranged on the one of side surface sides of the image forming apparatus, where the access surfaces to the maintenance parts are aggregated. A guide member 211 for guiding the substrate housing member 203 in the taking-out and putting-in direction is provided inside the image forming apparatus so that the substrate housing member 203 that serves the function to house and cover the electric board can be taken out and put in from the one of side surface sides of the image forming apparatus. The guide member 211 is illustrated in FIG. 9. With such a guide member 211, the operator can unfasten the screw fastening between the inner cover 201 and the substrate housing member 203, remove the inner cover 201 and the outer cover 202, and pull out the substrate housing member 203 from the image forming apparatus. That is, as illustrated in FIG. 11, the electric board can be taken out and put in from the one of side surface sides of the image forming apparatus.

Further, as illustrated in FIG. 7, a cover 212 made of a resin and the like and which covers the collected toner bottle is arranged on the one of side surfaces of the image forming apparatus, where the access surfaces of the maintenance parts are aggregated. The cover 212 is arranged on a lower side with respect to the access surface 222 to the mass storage device and the access surface 223 to the electric board.

The cover 212 that covers the collected toner bottle is fixed to the image forming apparatus by fastening with screws 230 at one or more places. The operator can access the collected toner bottle by unfastening the fastening between the image forming apparatus and the screw 230.

Further, as illustrated in FIG. 7, the detachably attachable holding member 236 that supplies the recording material as an object to be recorded to the apparatus main body of the image forming apparatus is arranged on the one of side surfaces of the image forming apparatus, where the access surfaces of the maintenance parts are aggregated. The access surface 225 at the time of attaching the holding member 236 is arranged on a front side of the image forming apparatus with respect to the access surfaces 221 to 224.

Figure 12:
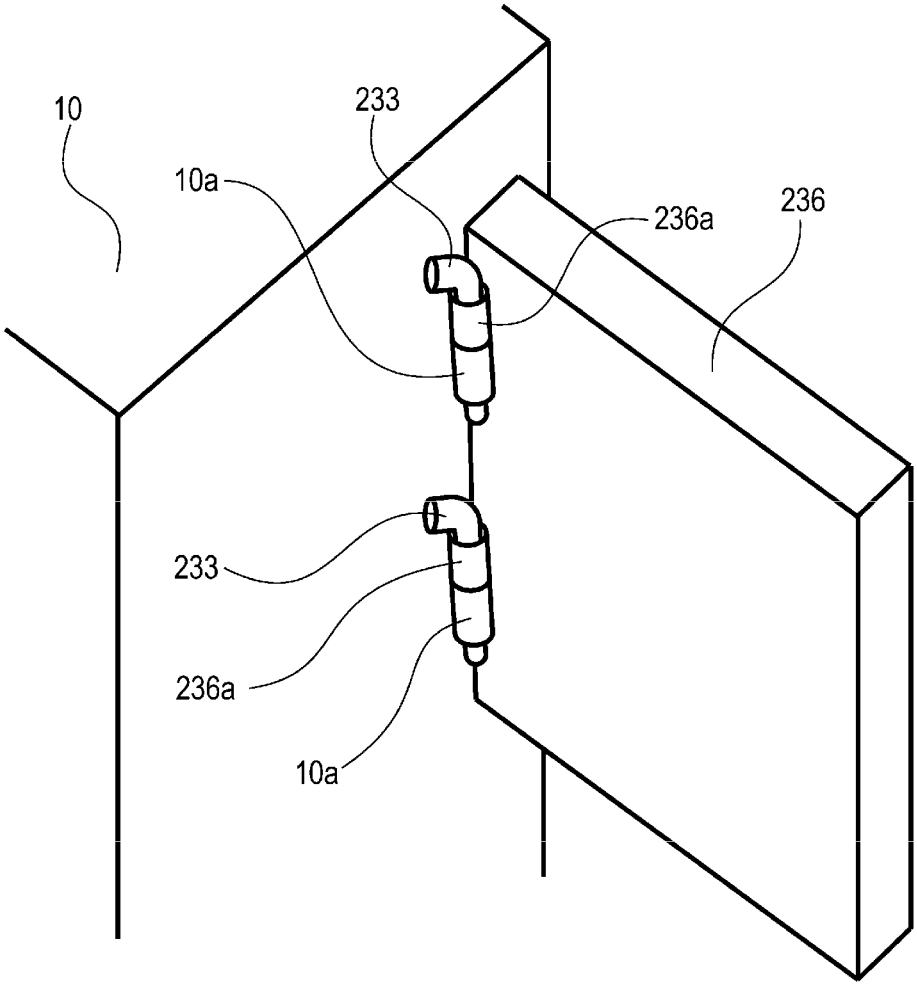
FIG. 12 is a perspective view of when a recording material supply holding member is taken out.

The detachably attachable holding member 236 that supplies the recording material as an object to be recorded of an image to the apparatus main body includes cylindrical support holes 236*a* in upper and lower two places on the depth side, as illustrated in FIG. 12. The image forming apparatus 10 includes cylindrical support holes 10*a* in upper and lower two places on the same axis as the cylindrical support holes 236*a* provided in the detachably attachable holding member 236 that supplies the recording material to the apparatus main body. The upper and lower cylindrical support holes 10*a* included in the image forming apparatus 10 are provided on a lower side with respect to the cylindrical support holes 236*a* included in the holding member 236, and receive a part of weight of the holding member 236.

The cylindrical support holes 10*a* and 236*a* of both the image forming apparatus 10 and the holding member 236 are fit and connected with common shaft members 233. The shaft member 233 has an L shape and thus does not slip through the hole at the time of insertion to the cylindrical support hole. Further, the shaft member 233 has a shaft diameter dimension with which the operator can manually pull out the shaft member 233 from the support holes of the image forming apparatus 10 and the holding member 236. Further, as illustrated in FIG. 7, a handle 234 held by the operator to open and close the holding member 236 is arranged on a front side with respect to the shaft member 233. Therefore, the holding member 236 can be rotated around the shaft member 233, and opened and closed.

With such a configuration, the operator can remove the holding member 236 that supplies the recording material that is an object to be recorded of an image to the apparatus main body from the image forming apparatus by opening the holding member 236 and removing the shaft member 233.

As described above, the present embodiment has a configuration in which the access surfaces to the other maintenance parts are aggregated and arranged on the one of side surfaces of the image forming apparatus, where the access surface 221 at the time of taking out the filter case 12 is provided. From this, replacement work of other maintenance parts can be easily performed, similarly to the plurality of filters, without securing a work space on the back surface side of the apparatus. Therefore, such configuration leads to reduction of the work space on the back surface side of the apparatus, and a burden on the operator in periodic maintenance can be reduced.

Note that the maintenance parts other than the filter described in the above-described embodiments are examples and are not limited thereto.

Further, in the above-described embodiments, the filter having a higher replacement frequency, of the plurality of filters housed in the filter case, may be housed on the front side in the drawing direction of the filter case. From this, cleaning and replacement work of the filters can be more easily performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-122299, filed Jun. 21, 2016, which is hereby incorporated by reference herein in its entirety.

What is claimed is:

1. An image forming apparatus comprising:

an exhaust duct provided on a back surface side of the image forming apparatus, including a first air duct and a second air duct through which air inside the apparatus is exhausted toward outside the apparatus in an exhaust direction, the first air duct and the second air duct being partitioned by a partition member;

a filter case provided in a drawable manner in a drawing direction perpendicular to the exhaust direction to one of side surface sides in a right and left direction or to an upper surface side in an up and down direction of the image forming apparatus, when viewing the image forming apparatus from a front surface side to the back surface side of the image forming apparatus; and a first filter and a second filter provided in the first air duct and the second air duct, respectively, configured to remove a fine particle included in the air, the first filter being provided in a more downstream side than the second filter in the drawing direction, the first filter and the second filter being housed in a manner that the filters are able to be taken out from the filter case, the first filter partially superimposing the partition member and the second filter not superimposing the partition member when viewing the image forming apparatus from the drawing direction.

2. The image forming apparatus according to claim 1, wherein the first filter has a higher replacement frequency than the second filter.

3. The image forming apparatus according to claim 1, wherein the exhaust duct is provided to protrude on a back surface of the image forming apparatus.

4. The image forming apparatus according to claim 1, wherein the exhaust duct is provided inside the image forming apparatus.

5. The image forming apparatus according to claim 1, further comprising:

a sealing member provided to the filter case or the exhaust duct, and which secures sealing between the air ducts, and applies a force to the filter case in the drawing direction when the filter case is attached to the image forming apparatus; and a stopper provided to the filter case, and which is engaged with the exhaust duct to hold the filter case in an attached position to the image forming apparatus, and is capable of cancelling the engagement by an elastic force.

6. The image forming apparatus according to claim 1, further comprising:

a maintenance part detachably attachable to the image forming apparatus, other than the filter, wherein the maintenance part is provided in a detachably attachable manner to the image forming apparatus from the one of side surface sides of the image forming apparatus to which the filter case is drawable.

7. The image forming apparatus according to claim 6, wherein the maintenance part other than the filter includes one of a mass storage device, an electric board, and a collected toner bottle.

8. The image forming apparatus according to claim 6, wherein the one of side surface sides is a surface side to which a holding member that supplies a recording material is attachable.

9. The image forming apparatus according to claim 6, wherein the filter case is provided on the back surface side of the image forming apparatus with respect to the maintenance part, on the one of side surface sides.

* * * * *